US007927138B2

(12) United States Patent
Ambo et al.

(10) Patent No.: US 7,927,138 B2
(45) Date of Patent: Apr. 19, 2011

(54) ELECTRICAL CONNECTOR

(75) Inventors: Tsugio Ambo, Tokyo (JP); Michiyasu Watanabe, Tokyo (JP); Satoshi Uramatsu, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 293 days.

(21) Appl. No.: 12/223,040

(22) PCT Filed: Jan. 24, 2007

(86) PCT No.: PCT/JP2007/051059

§ 371 (c)(1),
(2), (4) Date: Sep. 5, 2008

(87) PCT Pub. No.: WO2007/086407

PCT Pub. Date: Aug. 2, 2007

(65) Prior Publication Data

US 2010/0227501 A1 Sep. 9, 2010

(30) Foreign Application Priority Data

Jan. 25, 2006 (JP) ..... 2006-016026

(51) Int. Cl.
*H01R 13/40* (2006.01)

(52) U.S. Cl. ..... 439/589

(58) Field of Classification Search ..... 439/586–589, 439/595

See application file for complete search history.

(56) References Cited

U.S. PATENT DOCUMENTS 4,895,533 A 1/1990 Yagi et al.
5,720,487 A * 2/1998 Kato ..... 277/637

FOREIGN PATENT DOCUMENTS

JP 1-121276 U 8/1989
JP 9-45426 A 2/1997

* cited by examiner

*Primary Examiner* — Khiem Nguyen
(74) *Attorney, Agent, or Firm* — Holtz, Holtz, Goodman & Chick, PC

(57) ABSTRACT

An electrical connector that is reduced in size by appropriately combining connection terminals and a connector housing. Terminal insertion openings (15) for terminal accommodating holes (14) are formed in the rear face of the connector housing (11). The terminal insertion openings (15) each have an elliptic cross-section, and the ellipses are arranged so as to be aligned in a specific direction. Oblong sections of connection sections, having a narrow width, of the connection terminals are inserted into the terminal accommodating holes (14), along the terminal insertion openings (15). The connection terminals are engaged with elastic case lances and connection sections provided in the terminal receiving holes and are fixed in position.

4 Claims, 5 Drawing Sheets

ELECTRICAL CONNECTOR

This application is a U.S. National Phase Application under 35 USC 371 of International Application PCT/JP2007/051059 filed Jan. 24, 2007.

FIELD OF THE INVENTION

The present invention relates to an electrical connector for use in wire harnesses of automobiles and may be manufactured in a small size.

BACKGROUND OF THE INVENTION

In accordance with progress in performance of electric devices, the number of electric wires provided in various kinds of electric devices such as automobile harnesses has been increased. Therefore, diameters of electric wires have been reduced accordingly, and then connecting terminals for connecting the electric wires have been also miniaturized. Then it is required to arrange a large number of electrical connectors within a connector housing with a higher density.

DISCLOSURE OF THE INVENTION

Problems to be Solved by the Invention

However, in order to accommodate a large number of miniaturized connecting terminals within the connector housing, there is a sever problem in holding the connecting terminals at given position within the connector housing.

In a conventional connecting terminal of female type, as shown in FIG. 8, a connecting terminal 1 includes a connecting portion 2 provided at a front end and a clamping portions 3*a* and 3*b* formed at a rear end. A core conductor 5 of an electric wire 4 is connected to the connecting terminal at the clamping portion 3*a*. Moreover, a water proof sealing member 6 made of a synthetic rubber is provided on a sheath of the electric wire 4 and the sealing member 6 is fixed to the connecting terminal 1 by the clamping portion 3*b*. The sealing member 6 is to be brought into contact with an inner wall of a terminal insertion hole formed in a connector housing to prevent water from being introduced into the connector housing through the terminal insertion hole.

In order to fix such a connecting terminal 1 in the connector housing, a resilient case lance is projected from an inner wall of connector housing such that a free end of the case lance is engaged with a rear end of the connecting portion 2 to retain the connecting terminal 1 within the connecting housing. However, in order to hold the connecting terminal 1 in a positive manner, this portion could not be miniaturized sufficiently.

The present invention has for its object to provide an electrical connector which can remove the above mentioned drawback and a combination of the connecting terminals and connector housing can be miniaturized to a large extent.

Means for Solving the Problems

According to the invention, in order to achieve the above mentioned object, an electrical connector comprising a connector housing having case lances formed therein for holding connecting terminals within the connector housing, each of said case lances being projected inwardly into respective one of terminal accommodating holes formed within the connector housing and being engaged with a rear edge of a connecting portion having a substantially quadrilateral cross sectional shape to retain the connector terminal within the connector housing, characterized in that each of said connecting portions of connecting terminals is formed to have a substantially rectangular cross sectional shape, each of water proof portions of water proof sealing members provided on respective one of electric wires which are clamped on rear portions of the connecting terminals is formed to have a substantially elliptical cross sectional shape whose longitudinal axial direction is aligned with a longitudinal axial direction of a connecting portion of a relevant connecting terminal, each of terminal insertion openings of the terminal accommodating holes is formed to have a substantially elliptical cross sectional shape, and each of said connecting terminals is inserted into respective one of said terminal accommodating holes such that a longitudinal axial direction of the connecting portion of the connecting terminal is aligned with a longitudinal direction of a corresponding terminal insertion opening of the terminal accommodating hole.

Merits of the Invention

In the electrical connector according to the invention, the connecting portion having a substantially rectangular cross sectional shape and water proof sealing member having a substantially elliptical cross sectional shape are inserted in a terminal accommodating hole such that the longitudinal axial direction of the connecting portion and water proof sealing member are aligned with the longitudinal axial direction of the terminal insertion opening having a substantially elliptical cross sectional shape, and therefore a distance between adjacent connecting terminals installed within the connector housing can be reduced and the connecting terminals can be arranged with a higher density to attain a desired miniaturization.

EXPLANATION OF THE REFERENCE NUMERALS

Figure 1:
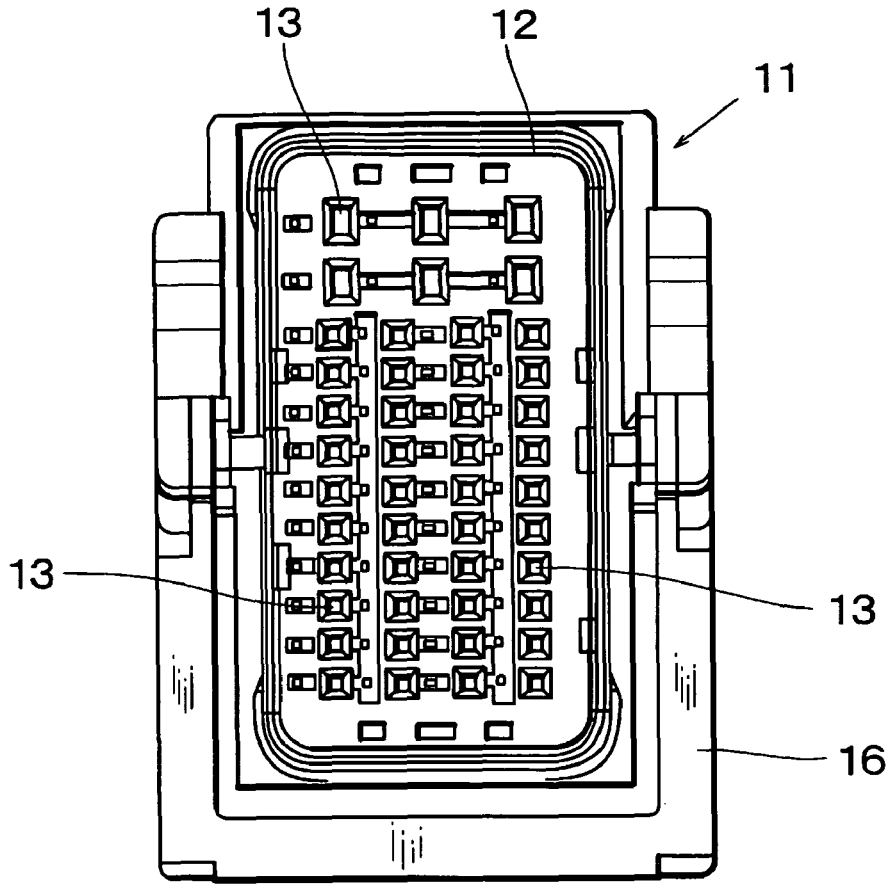
FIG. 1 is a front view showing a connector housing of an embodiment of the electrical connector according to the invention.

11 connector housing
14 terminal accommodating hole
15 terminal insertion opening
17 case lance
21 connecting terminal
22 connecting portion
23*a*, 23*b* clamp portion
24 electric wire
25 water proof sealing member
25*a* bellows

BEST MODES OF THE INVENTION

Now the present invention will be explained in detail with reference to an embodiment shown in FIGS. 1-7 of the attached drawings.

Figure 2:
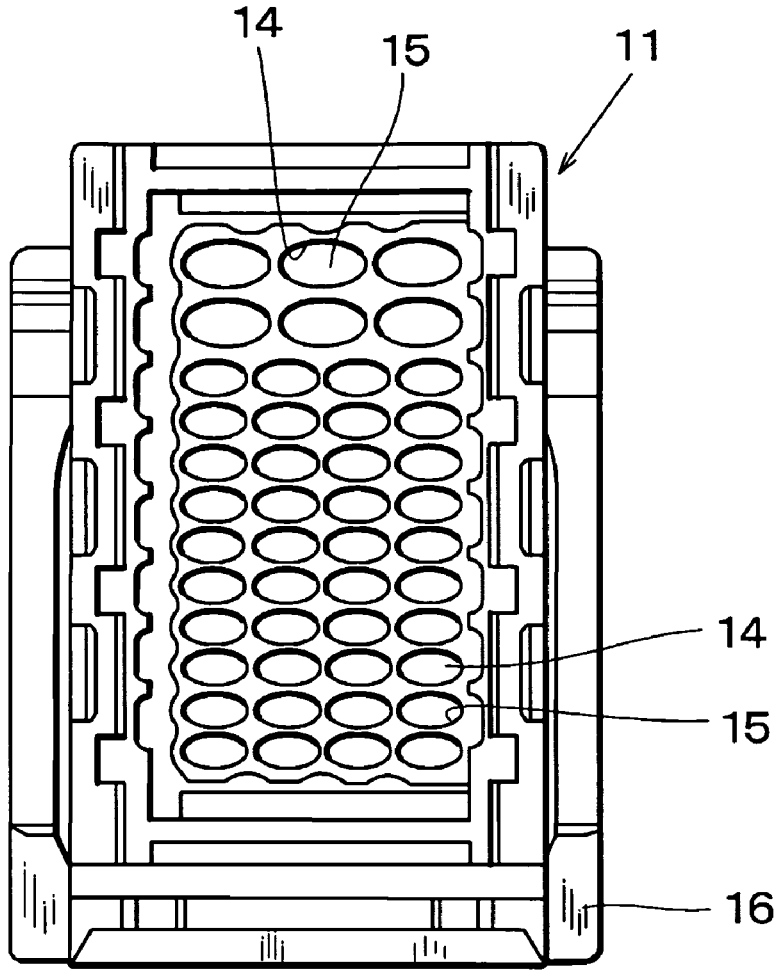
FIG. 2 is a rear view of the connector housing.
Figure 3:
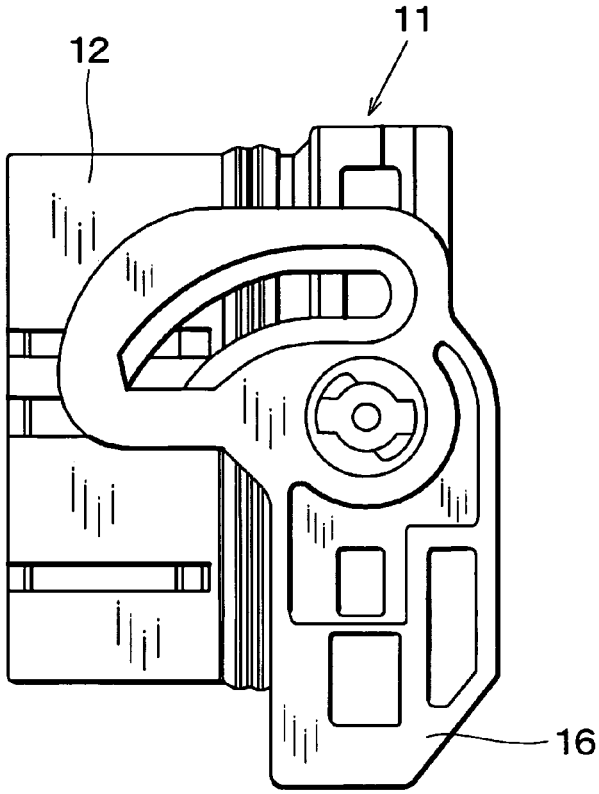
FIG. 3 is a side view of the connector housing.

FIG. 1 is a front view, FIG. 2 is a rear view and FIG. 3 is a side view showing an embodiment of a connector housing of the electrical connector according to the invention. At a front portion of the connector housing 11, there is formed a fitting portion 12 into which a cooperating connector housing is to be fit. Within the connector housing 11 there are formed a plurality of, for instance forty six terminal inserting holes 13 each having a rectangular cross sectional shape for receiving terminals of the cooperating connector housing. In a rear wall of the connector housing 11 there are formed terminal insertion openings 15 of terminal accommodating holes 14

Each of the terminal insertion openings 15 formed in the rear wall of the connector housing has a substantially elliptical cross sectional shape and longitudinal axial directions of these terminal insertion openings 15 are aligned in a given direction. In one section of the rear wall of the connector housing, there are formed forty terminal insertion openings 15 each having a size corresponding to extremely miniaturized connecting terminals and in another section of the rear wall there are formed six terminal insertion openings each having a size corresponding to a relatively large connecting terminal carrying a large electric current. In this case, according to the invention, the longitudinal axial direction of the terminal insertion openings 15 in one section may be different from the longitudinal axial direction of the terminal insertion openings 15 in another section.

Since the number of the connecting terminals installed within the connector housing 11 is large, there might be produced a relatively large contact resistance. In the present embodiment, a lever 16 is provided on a side wall of the connector housing 11 and a pin provided on a cooperating connector housing is fit into a cam hole of the lever. By operating the lever 16, the cooperating connector housing can be fit into the connector housing easily and positively against the large contact resistance.

Figure 4:
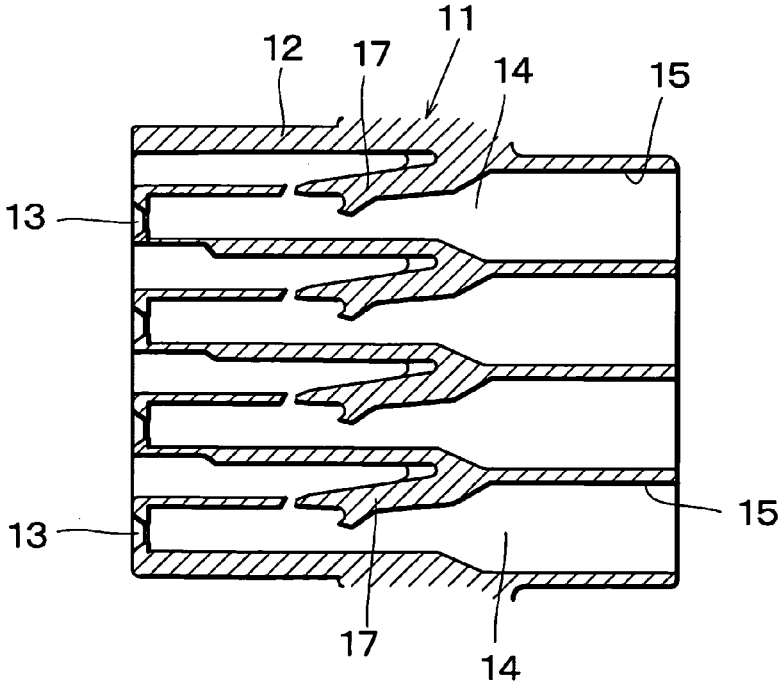
FIG. 4 is a cross sectional view depicting major portions of the connector housing.

FIG. 4 is a cross sectional view showing the connector housing 11 cut along the longitudinal axial direction of the terminal insertion openings 15 of the terminal accommodating holes 14. Resilient case lances 17 are formed on an inner wall of the connector housing to extend into the terminal accommodating holes 14 for preventing the connecting terminals from being removed backwardly.

Figure 5:
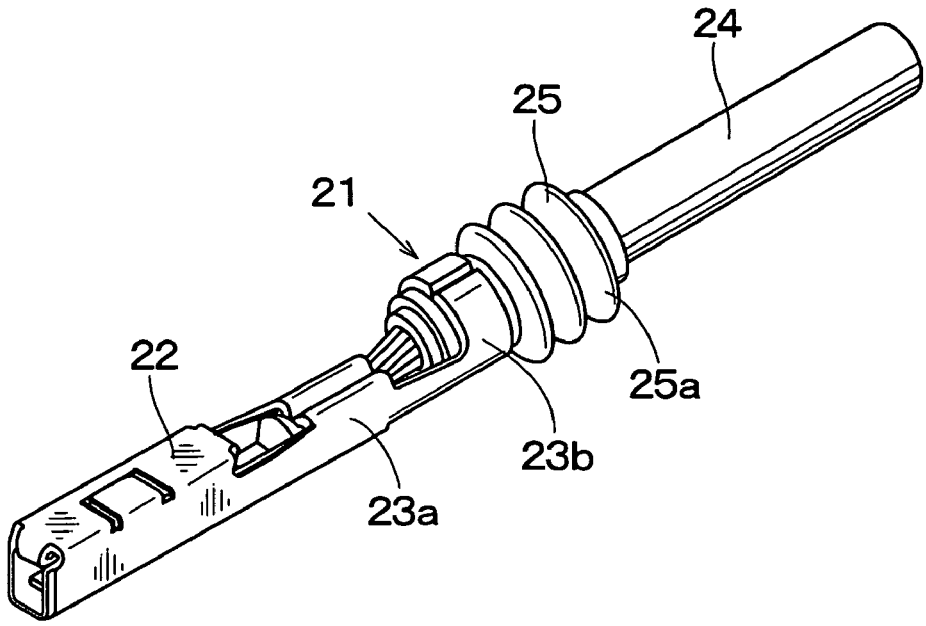
FIG. 5 is a perspective view representing a connecting terminal.

FIG. 5 is a perspective view illustrating a female type connecting terminal 21 to be installed within the terminal accommodating hole 14 of the connector housing 11. At a front end portion of the connecting terminal 21 is formed a connecting portion 22 which is to be contacted with a connecting terminal of the cooperating connector housing. An electric wire 24 is fixed by clamp portions 23*a*, 23*b* at a rear portion of the connecting terminal 21.

Figure 8:
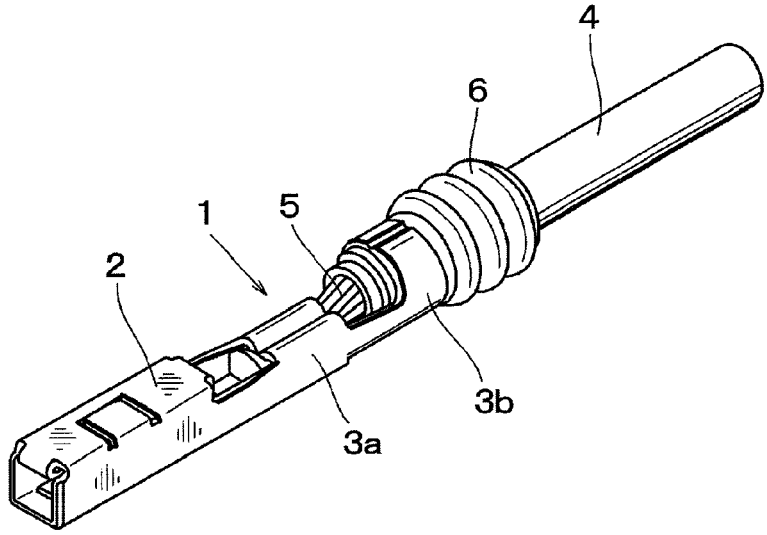
Fig.8 PRIOR ART
FIG. 8 is a perspective view showing a conventional connecting terminal.

Upon comparing the connecting terminal 21 with the conventional connecting terminal shown in FIG. 8, it is apparent that the connecting portion 22 is formed not to have a substantially square cross sectional shape, but have a substantially rectangular cross section. A length in a longitudinal axial direction of the connecting portion 22 is set to such a value that a free end of a case lance 17 can be positively engaged with a rear edge of the connecting portion 22.

Figure 6:
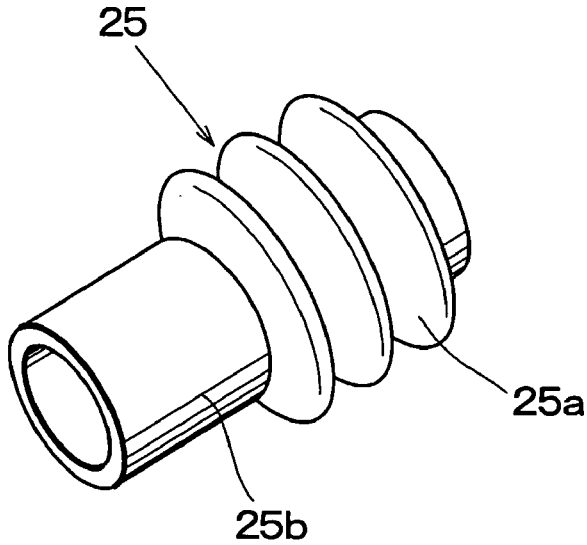
FIG. 6 is a perspective view showing a water proof sealing member.

A tubular water proof sealing member 25 made of a synthetic rubber is fit on the electric wire 24 and a front end portion of the water proof sealing member 25 is fixed by the clamp portion 23*b* of the connecting terminal 21. As best shown in FIG. 6, the water proof sealing member 25 includes a bellows 25*a* which has water proof function. An inner hole of the water proof sealing member 25 has a circular cross sectional shape, but the bellows 25*a* is formed to have a substantially elliptical outer configuration. An outer configuration of a circular portion 25*b* of the water proof sealing member 25 is formed to have a circular cross sectional shape.

The water proof sealing member 25 is fixed on the connecting terminal 21 such that a longitudinal axial direction of the bellows 25*a* is aligned with a longitudinal axial direction of the substantially rectangular connecting portion 22. It should be noted that the substantially elliptical cross sectional configuration of the bellows 25*a* is kept unchanged even after the water proof sealing member 25 is fit on the connecting terminal 21.

Figure 7:
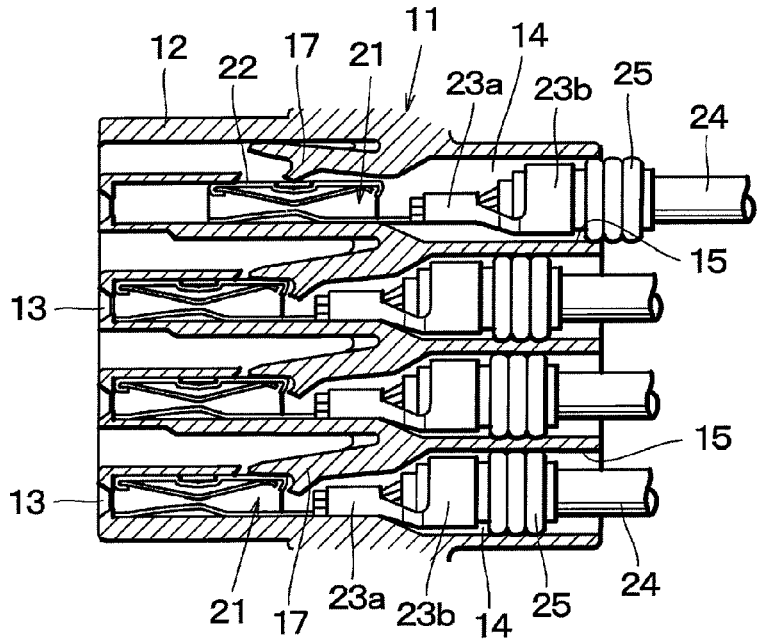
FIG. 7 is a cross sectional view illustrating major portions of the connector housing having connecting terminals installed therein.

When a connecting terminal 21 is inserted into the connector housing 11, a longitudinal axial direction of a connecting portion 22 of the connecting terminal 21 is aligned with a longitudinal axial direction of a terminal insertion opening 15 of a terminal accommodating hole 14. During the insertion, a resilient case lance 17 is pushed up by the connecting portion 22 of the connecting terminal 21 as shown in FIG. 7 at an uppermost row. When the connecting portion 22 is inserted into a given position, the case lance 17 is removed from an upper surface of the connecting portion 22 and is moved downward.

Then, a free end of the case lance 17 is engaged with a rear wall of the connecting portion 22 as illustrated in the lowermost row of FIG. 7, and the connecting terminal 21 could not be removed from the connector housing. At the same time, the water proof sealing member 25 having a substantially elliptical cross sectional shape is intimately contacted with an inner wall of the terminal insertion opening 15 to realize a water proof structure, because the longitudinal axial direction of the bellows 25*a* is aligned with the longitudinal axial direction of the terminal insertion opening 15.

In the above explained embodiment of the electrical connector according to the invention, the connecting terminals 21 of female type are installed within the connector housing 11, but according to the invention, female type connecting terminals may be equally inserted into the connector housing. In this case, a retaining portion provided at a rear side of a flat blade-like inserting portion of a connecting terminal is formed to have a substantially elliptical cross sectional shape. Then, the connecting terminals can be arranged with a higher density in combination with terminal insertion openings 15 having a corresponding cross sectional shape.

What is claimed is:

1. An electrical connector comprising:

a connector housing having a plurality of case lances formed therein for respectively holding within said connector housing a plurality of connecting terminals having connecting portions, a plurality of terminal insertion openings each having a substantially elliptical cross sectional shape and being aligned on a rear wall of said connector housing such that longitudinal directions of the elliptical cross sectional shapes of the terminal insertion openings are arranged in at least one direction, and a plurality of terminal accommodating holes in said connector housing respectively communicating with said plurality of terminal insertion openings, wherein each of said case lances is projected inwardly into a respective one of said terminal accommodating holes formed within the connector housing and is adapted to engage with a rear edge of one of the connecting portions having a substantially quadrilateral cross sectional shape to retain a corresponding connecting terminal within the connector housing, wherein each of said connecting portions of the connecting terminals is formed to have a substantially rectangular cross sectional shape, wherein each of water proof portions of water proof sealing members provided on a respective one of electric wires which are clamped on rear portions of the respective connecting terminals is formed to have a substantially elliptical cross sectional shape whose longitudinal direction is aligned with a longitudinal axial direction of the connecting portion of the corresponding connecting terminal and is engaged with said corresponding connecting terminal, and wherein each of said connecting terminals is inserted into a respective one of said terminal accommodating holes such that the longitudinal axial direction of the connecting portion of the connecting terminal and the longitudinal direction of the corresponding elliptical water proof portion of the water proof sealing member are aligned with a longitudinal direction of the corresponding terminal insertion opening having the elliptical shape.

2. The electrical connector according to claim 1, wherein said rear wall of the connector housing is divided into a plurality of sections, and the plurality of terminal insertion openings are formed such that sizes of said terminal insertion openings of the respective sections are different from each other and sizes of said connecting terminals inserted into the terminal insertion openings of the respective sections are different from each other.

3. The electrical connector according to claim 1, wherein said rear wall of the connector housing is divided into a plurality of sections and the longitudinal directions of terminal insertion openings formed in the respective sections are different from each other.

4. The electrical connector according to claim 1, wherein an inner hole of each of said water proof sealing members has a circular cross sectional shape and an outer configuration of a bellows portion of each water proof sealing member has the substantially elliptical cross sectional shape.

* * * * *